United States Patent [19]

Jentzsch et al.

[11] Patent Number: 4,867,062

[45] Date of Patent: Sep. 19, 1989

[54] METHOD OF AND A CIRCUIT FOR METERING INK IN ROTARY PRINTING MACHINES

[75] Inventors: Arndt Jentzsch; Wolfgang Mueller, both of Coswig; Falko Missbach, Meissen; Volker Eichler, Weinboehla, all of German Democratic Rep.

[73] Assignee: VEB Polygraph, Radebeul, German Democratic Rep.

[21] Appl. No.: 213,617

[22] Filed: Jun. 30, 1988

[30] Foreign Application Priority Data

Jul. 1, 1987 [DD] German Democratic Rep. ... 304411

[51] Int. Cl.[4] ..... B41F 31/06; B41F 33/10; B41L 27/08

[52] U.S. Cl. ..... 101/350; 101/484

[58] Field of Search ..... 101/350, 349, 363, 365, 101/148, 364, 207, 208–210

[56] References Cited

U.S. PATENT DOCUMENTS 4,765,241 8/1988 Hank et al. ..... 101/350

FOREIGN PATENT DOCUMENTS 125618 5/1977 German Democratic Rep. ..... 101/350

*Primary Examiner*—J. Reed Fisher

*Attorney, Agent, or Firm*—Michael J. Striker

[57] ABSTRACT

An ink metering method for an inking mechanism of a rotary printing machine having an ink fountain, a doctor roller, a separate electric motor for driving the doctor roller and a low speed of rotation relative to the printing machine, includes the selection of a rate at which the electric motor imparts to the doctor roller discrete angular motions; and selecting by a second selector switch the magnitude of the angular motions. A circuit arrangement for carrying out the method includes a time selection unit which delivers at its output a series of pulses at a desired rate; an increment evaluation unit which receives at its input a number of pulses corresponding to the magnitude of the angular motion performed by the electric motor and compares the momentary number with a preset desired number corresponding to a desired magnitude of the angle of rotation.

9 Claims, 2 Drawing Sheets

METHOD OF AND A CIRCUIT FOR METERING INK IN ROTARY PRINTING MACHINES

BACKGROUND OF THE INVENTION

The present invention relates to a method of and a circuit arrangement for metering or proportioning of ink in a printing machine provided with ink fountain and an ink doctor roller driven by a separate motor.

The metering or dosing of printing ink according to different printing applications by means of an ink fountain provided with an ink blade adjustable by means of zone screws and being in contact with an adjustable ink doctor roller is known since long time. To meet the general requirement for continuously increasing the printing efficiency, a large number of new solutions has been recently devised. However, such known solutions are frequently very complicated in construction.

From the DD-Pat. No. 212 475 a solution is known in which an ink film is metered toward the ink doctor by adjusting zone screws acting on the ink blade. The ink film is periodically withdrawn from the ink doctor by an ink lifter and transferred to the first ink distributing cylinder. The ink lifter is swung by means of a cam roller control in such a manner that every 2½ rotations of the printing plate cylinder it engages the ink doctor and the first ink distributing cylinder. By means of an electrical control activated by a selector switch it is possible to change the swinging frequency of the ink lifter such that it is brought into engagement with the ink doctor once after each fifth or tenth rotation of the printing plate cylinder.

This known device provides satisfactory ink metering for most applications. Its disadvantage however is the fact that the engagement or contact time of the ink lifter is not adjustable and consequently the ink metering cannot be set with sufficient sensitivity.

In an ink metering device according to DE-AS No. 1 761 394 the ink doctor is driven by the printing machine at a constant rotary speed ratio and the ink is transferred by an ink lifter to the first ink distributing cylinder. The times of engagement of the ink lifter roller with the ink doctor and the first distributing cylinder are adjustable by means of two timing devices which cooperate with a changeover device. The latter device consists of a large number of component parts and is very complex in construction and consequently expensive in manufacture. An accurate reproduction of a preceding setting is not possible on this known device.

A device for ink metering has been also proposed in which the ink is taken off by a milling roller rotating at the speed of the printing machine and being arranged at a minute distance from a shiftable ink doctor roller. An ink lifter roller transfers the ink from the milling roller onto the first ink distributing cylinder. By means of this known device an adequate ink metering can be achieved. Its disadvantage however is the necessity of a large number of components and consequently high manufacturing costs.

SUMMARY OF THE INVENTION

It is therefore a general object of the present invention to overcome the aforementioned disadvantages.

In particular, it is an object of the invention to provide a method of and a circuit for ink metering which enable the regulation of the ink dosing in smallest steps.

Another object of this invention is to provide such a method and circuit arrangement which permit a high accuracy in reproducability of the set metering.

Still another object of this invention is to eliminate ink lifters and ink lifter control devices which hitherto have been conventional in inking mechanisms of this kind.

In keeping with these objects and others which will become apparent hereafter, one feature of the invention resides, in an ink metering method wherein by a first preselector switch the number of machine cycles after which the ink doctor performs a metering step is selected; and the magnitude of the metering step is preselected by means of a second preselector switch The ink is taken off by a conventional inking roller engaging the ink doctor roller. In this manner the dosing or metering step can be selectively executed after two, four or eight machine cycles. Each dosing step or increment of the ink doctor is carried out continuously from its beginning to its end without any stoppage.

The circuit arrangement for controlling the incremental drive of the doctor includes a servo-drive consisting of a separate electric motor, power supply through a rectifier and a tachometer generator which is connected to the drive of the printing machine and supplying its output voltage to the rectifier via the collector-emitter path of an opto-coupler. The light emitting diode of the opto-coupler has its anode connected to the output of a binary store and its cathode is grounded via a limiting resistor. The set input of the store is connected to an output of a time preselector and to an input of AND gate whose other input is connected to the output of an increment transmitter coupled to the electric motor. The output of the AND gate is connected to the input of a counter of an increment evaluation unit. The output of the evaluation unit is connected to the resetting input of the binary store and to resetting input of the counter. The time preselection unit includes a first selector switch whose contacts are connected to first inputs of assigned AND gates. The other inputs of respective AND gates are connected to outputs of a time preparation unit which delivers pulses at a preset ratio to the cycles of the printing machine. The outputs of the respective AND gates are connected to the inputs of an OR gate whose output forms the output of the time preselector unit. The increment evaluation unit further includes a comparator whose first set of inputs is connected to the outputs of the counter and whose other set of inputs is connected to a binary coded decimal (BCD) second preselection switch whose position determines the length of the actuation of the servo drive. The servo drive is designed either as a DC or AC four-quadrants drive.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
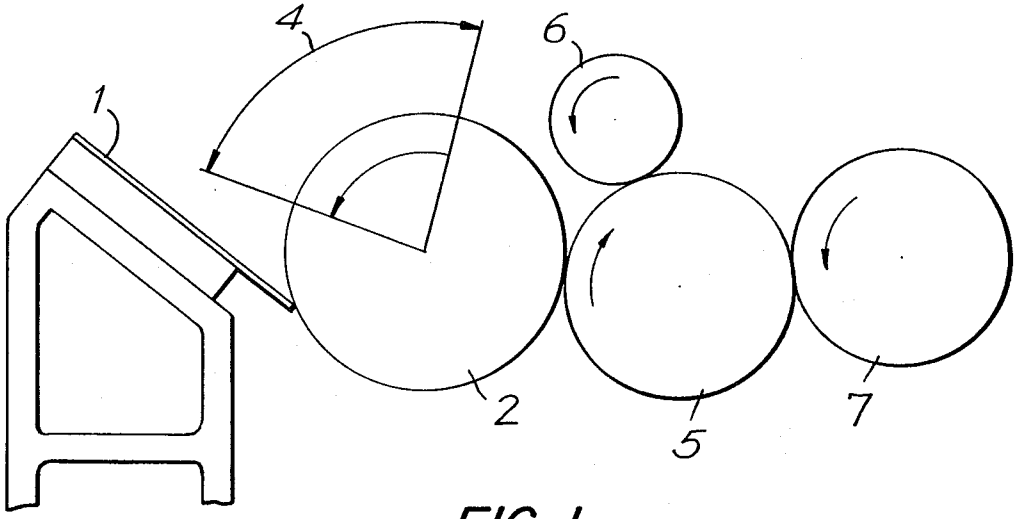
FIG. 1 is a schematic representation of a part of an ink mechanism of a rotary printing machine.

Referring firstly to FIG. 1, an ink fountain 1 is provided with an ink blade adjustable by non-illustrated zone screws and engaging an ink doctor roller 2. The doctor roller 2 is driven by a separate servo drive controlled by a circuit arrangement of this invention as it will be explained later. The ink metering step 4 is preselectable in its length by the selection of the angle of rotation of the doctor roller 2. The timing of the metering step 4 is also preselectable, that means a metering step occurs after two, four or eight cycles or rotations of the printing plate cylinder of the machine. Inking roller 5 which rotates for example at the speed of the printing machine takes off a certain part of the thickness of the ink layer present on the ink doctor roller 2.

The rider roller 6 is arranged on the inking roller 5 and serves for intercepting sputtered ink and distribute the same on the inking roller 5. The ink on the inking roller 5 is transferred on the first ink distributing cylinder 7 and therefrom it is transferred by a non-illustrated pack of rollers on the printing plate cylinder of the machine.

Figure 2:
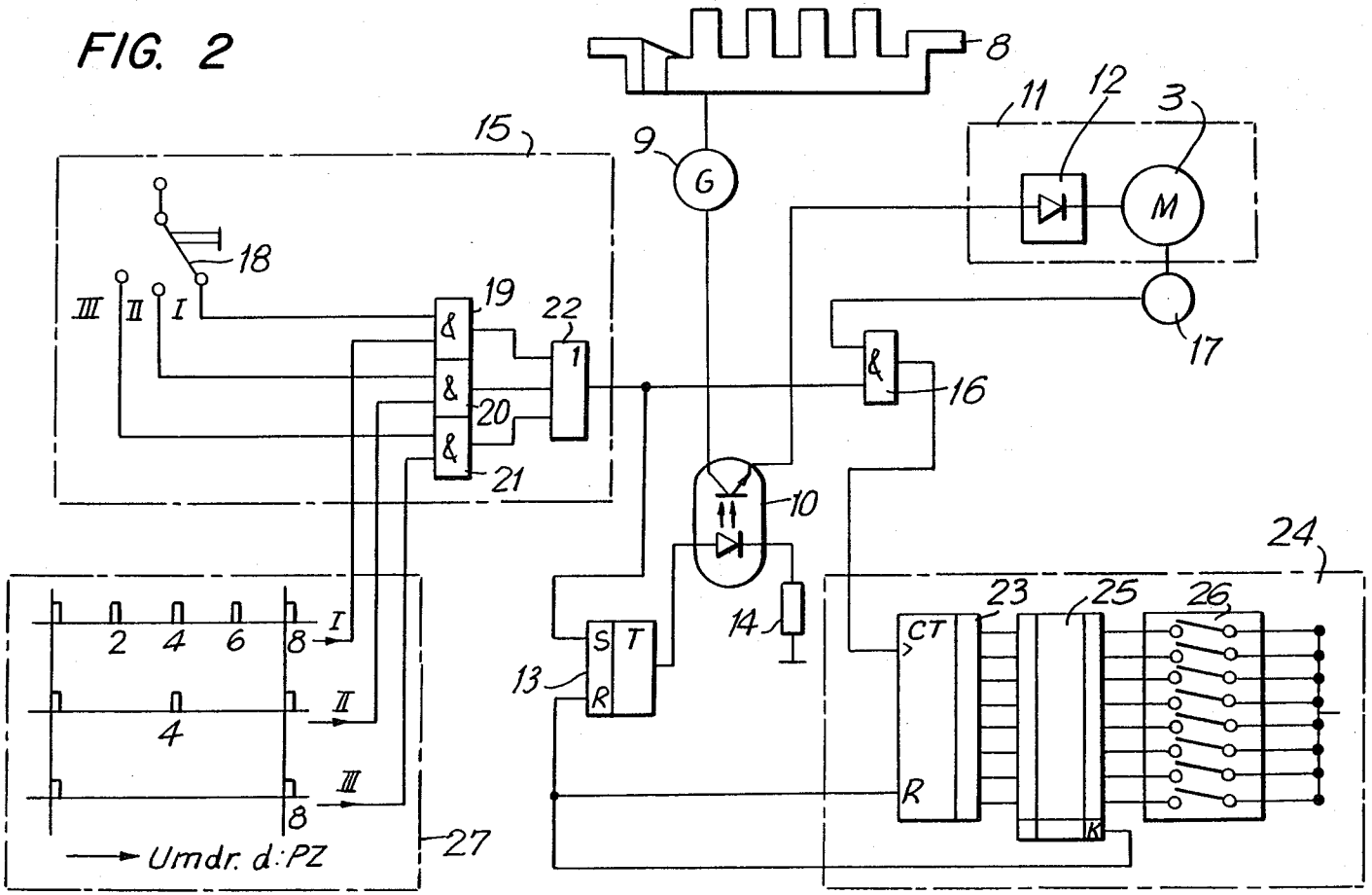
FIG. 2 is a schematic diagram of a circuit arrangement for controlling the ink metering in accordance with this invention.

Referring to the circuit arrangement of FIG. 2 the electric motor 3 is directly coupled to the ink doctor roller 2 and is controlled in dependency on the operational cycles of the printing machine. The drive of the printing machine 8 is coupled to a tachometer generator 9 whose output is connected via the collector-emitter path of an opto-coupler 10 with the input of a 4-quadrant servodrive 11 which includes rectifier 12 and the electric motor 3. The light emitting diode of the opto-coupler 10 has its anode connected to the output of a binary store 13 and its cathode is grounded via a limiting resistor 14. The setting input of the store 13 is connected to the output of a time preselection unit 15. This output is also connected to an input of an AND gate 16 whose other input is connected to an increment signal transmitter 17 coupled to the electric motor 3. The time preselection unit 15 consists of a first selector switch 18 having three contacts I, II and III, of three AND gates 19, 20 and 21 each having an input connected to an assigned contact of the selector switch and an output connected to an input of an OR gate 22 whose output forms the output of the unit. The other inputs of respective AND gates are connected to outputs of a timing preparation unit 27 which delivers pulses at predetermined ratios to the operation cycles of the printing machine, as it will be explained later.

The output AND gate 16 is connected to the counting input of a counter 23 of the increment evaluation unit 24. The evaluation unit consists, apart from the counter 23, of a comparator 25 and a binary coded decimal (BCD) second selector switch 26. The digital value at the output of the counter 23 is compared in the comparator 25 with the digital value selected by the switch 26. The output of the comparator 25 is connected to the resetting inputs R on the counter and on the binary store 13.

The time preparation unit 27 is coupled to the drive of the printing machine to deliver at its output I a series of pulses at a rate corresponding to the rotary speed of the printing machine divided by 2, that means it delivers a pulse after two rotations of the printing plate cylinder or machine cycles. The output II of the unit 27 delivers a pulse after four rotations and the output III delivers a pulse after eight rotation of the printing plate cylinder. The output I of the unit 27 is connected to the other input of the AND gate 19 and as mentioned before the first input of the AND gate is connected to the contact I of the switch The output II of the unit 27 is connected with the other input of the AND gate 20 and the first input of the AND gate is connected with contact II of the switch 18. The output III of the unit 27 is connected with the other input of the AND gate 21 whose first input is connected to the contact III of the switch 18. The output of respective AND gates 19 through 21 are connected to inputs of the OR gate 22 whose output forms the output of the time preselection unit 15 and is connected with the setting input of the binary store 13 and with an input of the AND gate 16.

In operation, the magnitude of the ink metering step 4 is preselected by the second selector switch 26 of the increment evaluation unit 24. By means of the first selector switch 18 the time sequence of the metering is determined that means after how many rotations of the printing plate cylinder the ink doctor roller 2 is to perform the respective ink metering steps. The tachometer generator 9 coupled to the drive of the printing machine 8 delivers a voltage which is proportional to the rotary speed of the machine. The voltage is applied via the opto-coupler 10 and the rectifier 12 to the electric motor 3. When the output of the binary store 13 is high (H) the opto-coupler 10 is activated and connects the voltage of the generator 9 to the rectifier 12 thus activating the electric motor 3. The increment transmitter 17 delivers a series of pulses corresponding to the angular increments of the electric motor 3 and as long as the first input of the AND gate 16 is high this pulse series is delivered to the counting input CT of the counter 23. The first selector switch 18 of the time preselection unit 15 determines whether each second, each fourth or each eighth pulse derived from the cycles of the printing machine by the time preparation unit 27 is to be applied to the first input of the AND gate 16. As mentioned before, the output pulses from the time preselection unit 15 determine via the AND gate 16 the counting of the output pulses from the increment transmitter 17 in the evaluation unit 24. The comparator 25 compares the count of pulses in the counter 23 with the number preset by the second selector switch 26. When the counted pulses are identical with preset number, the output K of the comparator 25 clears the counter 23 to zero value and the binary store 13 is also reset. As a consequence the opto-coupler 10 interrupts the power supply to the electromotor 3 and the latter stops. The preset individual ink metering steps 4 are performed continuously without any intermediate stoppage.

What is claimed as new and desired to be protected by Letters Patent is set forth in the appended claims:

1. A circuit arrangement for controlling an electric motor for driving a doctor roller in an inking mechanism of a printing machine including an ink fountain in engagement with the doctor roller and an ink transfer roller in engagement with the doctor roller, comprising a tachometer generator coupled to the printing machine to deliver a supply voltage for said electric motor; an opto-coupler for controlling the connection of said tachometer generator to said electric motor; a time preselection unit delivering at its output a series pulses and including a first selector switch for selecting the desired rate of said series; an increment evaluation unit including a counter, a comparator and a second selector switch for selecting a number of increments corresponding to a desired magnitude of discrete angular motions of said electric motor; means for activating said opto-coupler when a pulse is delivered at said output of the time preselection unit; and means for inactivating said opto-coupler when the magnitude of the angular motion of the electric motor has reached the value set by said second selector switch.

2. A circuit arrangement as defined in claim 1, wherein, said first selector switch of said time preselection unit includes a three-position selector switch, three AND gates each having an input connected to an assigned contact of the first selector switch and an output connected to an input of an OR gate, the output of said OR gate forming the output of said time preselection unit, and a pulse generator having three outputs each delivering a series of pulses at a different rate, said outputs being connected to assigned other inputs of respective said AND gates, a binary store having a setting input connected to the output of said comparator in the increment evaluation unit, an increment generator coupled to said electric motor to generate a series of pulses whose number corresponds to the magnitude of the angular motion of the motor, a further AND gate having an input connected to the output of said time preselection unit and another input connected to the output of said increment generator and an output connected to said counter of the increment evaluation unit.

3. A circuit arrangement defined in claim 2, wherein said comparator in the increment evaluation unit compares the momentary count value of said counter with a binary coded number value preset by said second selector switch and when the two values are equal delivering a resetting pulse to said binary store and to said counter.

4. A circuit arrangement as defined in claim 3, wherein said pulse generator of the time preselection unit delivers three series of output pulses whose rate correspond respectively to the rate of the printing machine divided by 2, by 4 and by 8.

5. A circuit arrangement as defined in claim 1, wherein said electric motor is part of a servo drive including a rectifier to operate both at a DC and at a AC supply voltage.

6. A method of metering ink in a printing machine operating in cycles and having an inking mechanism including an ink fountain, a doctor roller in engagement with the fountain, a separate electric motor for driving the doctor roller, and an ink transfer roller in engagement with the doctor roller, comprising the steps of generating a first series of pulses at a pulse rate corresponding to a predetermined ratio of the actual operating cycles rate of the printing machine; timing the starting of the electric motor in response to said first series of pulses and driving the electric motor at a relatively low speed which is proportional to the actual rotary speed of the printing machine; generating a second series of pulses at a pulse rate proportional to the actual rotary speed of the electric motor; obtaining an actual count of said second series of pulses; setting a desired count of pulses in said second series to define a desired magnitude of angular motion of the driving motor; comparing said desired count with the actual count of pulses in said second series and stopping the electric motor when the two counts are equal.

7. A method as defined in claim 6, further comprising the steps of generating a plurality of said first series of pulses at different pulse rates, selecting by a first selection switch one of said first series to set a desired number of operating cycles after which the electric motor is started to impart to the doctor roller a discrete angular motion; and selecting by a second selection switch the desired magnitude of said angular motion to withdraw from the fountain a layer of ink corresponding to a selected rate and magnitude of the angular motions of said doctor roller.

8. A method as defined in claim 7, wherein said first selection switch selects two, four or eight machine cycles after which the electric motor is activated.

9. A method as defined in claim 7, wherein each discrete angular motion is continuous.

* * * * *